United States Patent [19]

Nigrelli

[11] 4,317,320

[45] Mar. 2, 1982

[54] IN-LINE CARTON SLITTING, FLAP FOLDING AND FLAP GLUING APPARATUS

[75] Inventor: Biagio J. Nigrelli, Kiel, Wis.

[73] Assignee: Johns-Nigrelli-Johns, Inc., Sheboygan Falls, Wis.

[21] Appl. No.: 76,034

[22] Filed: Sep. 17, 1979

[51] Int. Cl.[3] ..... B65B 7/20; B65B 7/26

[52] U.S. Cl. ..... 53/374

[58] Field of Search ..... 53/374, 375, 376, 491, 53/382; 93/49 R; 493/70, 80, 182, 183, 1

[56] References Cited

U.S. PATENT DOCUMENTS

| | | | |
|---|---|---|---|
| 2,268,423 | 12/1941 | Rose . | |
| 2,625,778 | 1/1953 | Wood | 53/374 |
| 2,890,560 | 6/1959 | Nigrelli et al. . | |
| 2,929,183 | 3/1960 | Magna | 53/491 X |
| 3,228,172 | 1/1966 | Johnson et al. | 53/374 |
| 3,533,214 | 10/1970 | Standley . | |
| 3,726,061 | 4/1973 | Pagdin et al. | 53/374 X |
| 3,821,875 | 7/1974 | Paxton . | |
| 4,160,351 | 7/1979 | Mais et al. | 53/382 X |
| 4,191,005 | 3/1980 | Vinoskey | 53/382 |

FOREIGN PATENT DOCUMENTS

| | | | |
|---|---|---|---|
| 384740 | 10/1973 | U.S.S.R. | 53/374 |

*Primary Examiner*—Horace M. Culver

*Attorney, Agent, or Firm*—Wheeler, House, Fuller & Hohenfeldt

[57] ABSTRACT

Apparatus for closing the flaps on a carton in an in-line path includes rotary brushes located on opposite sides of the conveyor path with the bristles extending toward and within the carton conveying path. In one embodiment, the bristles on the brushes sweep the leading carton flap upwardly and rearwardly over the carton top to close the leading flap as the cartons are conveyed past the bristles. The trailing flap brushes engage the trailing carton flap and fold the flap upwardly and forwardly over the carton. The side flaps are folded over the end flaps by folding plows after glue has been applied to the end flaps. The apparatus also includes slitting knives for severing the connections between the edges of downturned carton flaps prior to movement of the cartons to the flap folding station.

14 Claims, 11 Drawing Figures

IN-LINE CARTON SLITTING, FLAP FOLDING AND FLAP GLUING APPARATUS

BACKGROUND OF THE INVENTION

Some shipping cartons are manufactured with the closure flaps folded downwardly along the sides and ends of the cartons. The flaps are maintained in the open downturned position along the sides of the carton by short integral paperboard strips or webs which connect the side flaps and end flaps at diagonally opposite corners of the carton. The flaps thus do not extend outwardly and the cartons are more easily handled during filling operations. To close the flaps after the carton is filled, the attaching webs between the end and side flaps are slit or severed to enable folding of the flaps to the closed position over the top of the carton and its contents. Conventional folding apparatus employs folding plows arranged along the sides of the moving carton to flip the flaps upwardly and over the top of the carton as the carton is conveyed between the plows. The carton must be shifted 90° to employ such folding plows to flip the end flaps after the side flaps are folded or vice versa. One such arrangement requires two conveyors at right angles. Other apparatus requires bump turning. This arrangement is impractical where there are space limitations in the carton filling facility. U.S. Pat. No. 3,533,214 is illustrative of right angle conveyors to accomplish slitting of flap webs.

SUMMARY OF THE INVENTION

The apparatus of the invention includes rotating brush assemblies for folding the leading and trailing flaps of filled cartons as they are conveyed to a glue station and before the other flaps are folded. In the disclosed embodiment, the brush assemblies have circular disc shaped heads with bristles extending outwardly from a bristle mounting head. Brushes having other shapes, i.e. cylindrical, tapered, etc. could be employed to obtain some of the advantages of the invention. The bristle heads are adjustably supported for rotation at an appropriate angle with respect to the conveying path so that the bristles converge into the conveying path to engage and sweep the cartons leading and trailing flaps in the direction required to fold the flaps over the top of the carton. The brushes are easily adjusted for different size cartons by mounting heads which enable universal adjustment. The brush elements are desirably yieldable or compressible because the cartons squeeze through the spaced brushes during the folding action.

After the leading and trailing or end flaps are folded, the cartons are conveyed to a glue application station where glue is applied on the folded end flaps and the other flaps are plowed shut over the end flaps. The apparatus of the invention is appropriate for closing carton flaps whether they are end or side flaps if the cartons are conveyed past the brushes as herein disclosed.

The brush assemblies provide an efficient and easily adjusted mechanism for folding flaps without the complex mechanisms shown in various prior art patents such as U.S. Pat. Nos. 2,268,423; 3,821,875; and 3,533,214.

Further objects, advantages and features of the invention will be apparent from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 3:
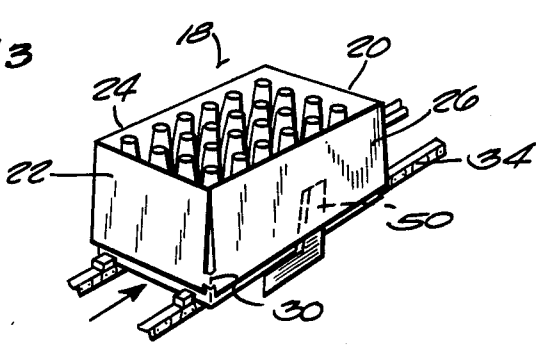
FIG. 3 is a fragmentary diagrammatic perspective view of the fixed knife and associated conveyor shown in FIGS. 1 and 2.
Figure 8:
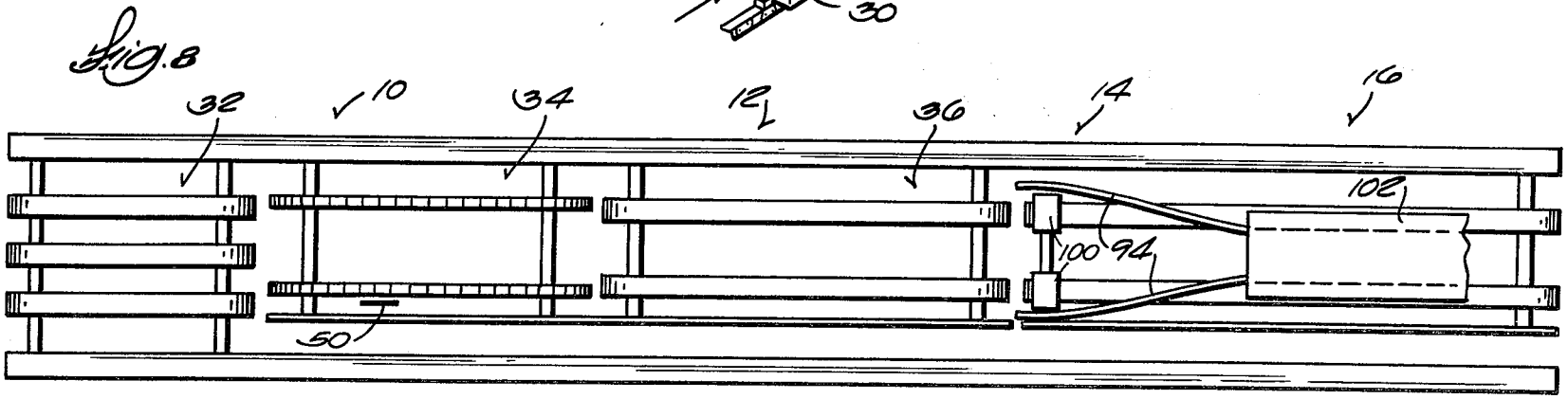
FIG. 8 is a plan view of the apparatus shown in FIG. 7.
Figure 7:
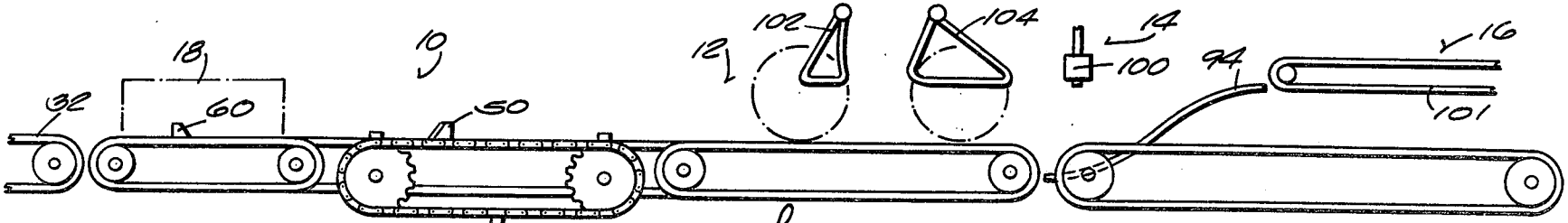
FIG. 7 is a diagrammatic side elevational view similar to FIG. 2 of the carton slitting station and brush folding station and including a glue station and a sealing station.
Figure 6:
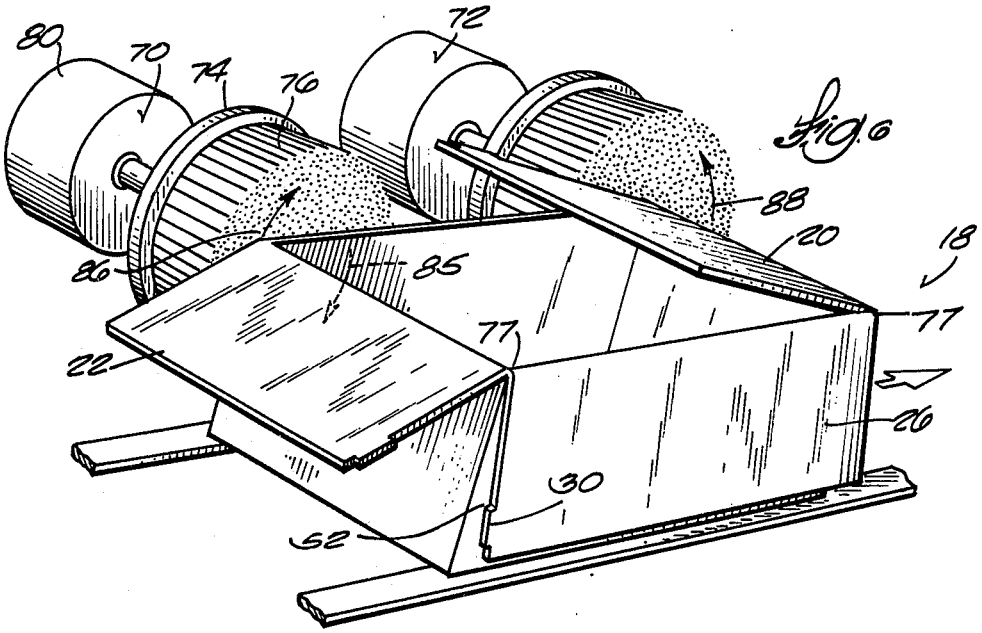
FIG. 6 is an enlarged diagrammatic perspective view showing action of the brushes on one side of the conveying path.

The apparatus disclosed herein (FIGS. 7 and 8) includes a carton slitting station 10, a flap folding station 12, a glue station 14 and a sealing station 16. The cartons 18 processed by the apparatus are best shown in FIGS. 3 and 6. The cartons 18 have front or leading end flaps 20 and rear or trailing end flaps 22 and side flaps 24 and 26. The cartons as manufactured have connecting webs 28 and 30 at diagonally opposite corners (FIG. 5) which connect the end and side flaps and maintain these flaps in close relation to the container side and end walls to facilitate handling of the cartons prior to loading and sealing. Although the apparatus disclosed is provided with a slitting station 10 to slit the webs 28, 30 prior to folding the flaps over the container, the brush folding apparatus of the invention hereinafter described can be employed with cartons which are manufactured without the connecting webs 28 and 30.

The cartons 18 are transported during the sequence to and through the slitting station 10 and brush folding station 12 to a gluing station 14 and sealing station 16 with a series of in-line conveyors. Index conveyor 32 (FIGS. 1 and 2) delivers the cartons 18 to the conveyor 34 which moves the cartons 18 through the slitting station to a conveyor 36 which conveys the cartons through the folding station 12. The conveyor 32 delivers the cartons 18 to the conveyor 34 in timed and spaced sequence to prevent interference with the flight bars or lugs 44 (FIG. 2) carried by spaced chains 35.

The index conveyor 32 includes a retractable stop 46 which is adjustable longitudinally of the conveyor 32 and swung into and from the path of cartons carried by conveyor 32 by a linkage and power cylinder assembly 48. Actuation of the power cylinder linkage assembly 48 to lower the stop 46 beneath the conveyor path releases the cartons 18 so that they are picked up and pushed by the lugs 44 on the chains 45.

Associated with conveyor 34 is a fixed slitting blade 50 for severing the web 30 which connects the trailing flap 22 to the side flap 26. The moving flight bar of lugs 44 urges the carton web 30 against the knife 50 to make the cut. The knife blade 50 is positioned so that it will enter the gap 52 (FIG. 5) between the side flap 26 and the carton side wall and pass along inside the flap 26 until the web 30 is severed.

The web 28 connecting the leading flap 20 and the side flap 24 is severed by a traveling knife 60 (FIGS. 1, 2) carried by a chain 62 which makes a circuit spanning both conveyors 32 and 34. A stop 66 which is movable from beneath the conveyor bed into the conveying path holds the carton against movement while the knife 60 enters the gap 78 (FIG. 5) and moves forwardly along the side of the carton toward the front web 28. The side flaps 24 and 26 can be flared slightly outwardly by vacuum heads arranged along the sides of the conveyor to facilitate entry of the slitting knives under the flaps.

Figure 9:
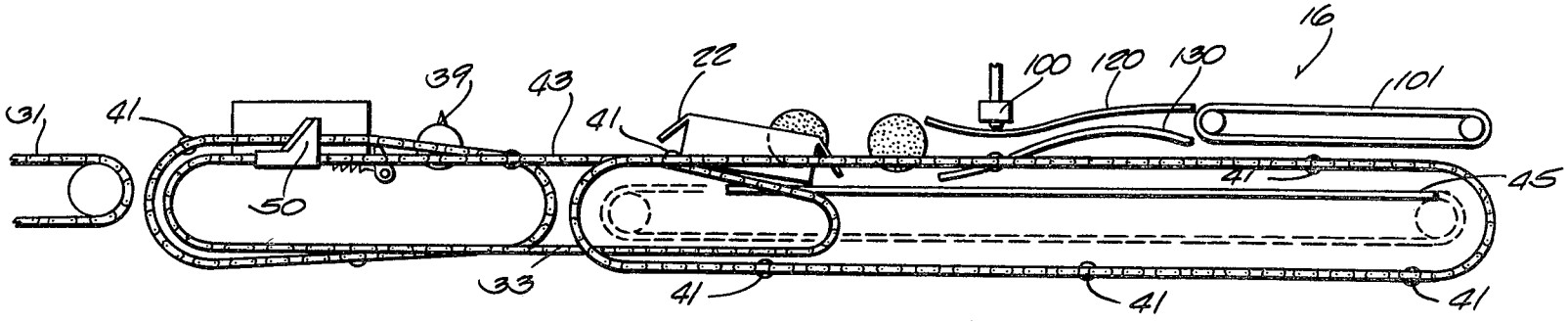
FIG. 9 is a diagrammatic side elevational view of a modified embodiment of the apparatus of the invention.

FIG. 9 illustrates a modified embodiment of the conveying and slitting system which includes an index conveyor 31 which is cycled to deliver cartons in sequence to a conveyor 33. Slitting of the connecting web is accomplished by a fixed knife 50 on one side of the conveyor 33 and a rotary fly knife 39 on the other side of the conveyor. Lugs or bars 41 carried on spaced chains 43 drive the carton past the fixed knife 50. The conveyor 33 deposits the carton on a conveyor 45 which supports the cartons for movement through the flap folding station and gluing station. As the carton (FIG. 9) moves down the incline to conveyor 45, the flight bar 41, which is moving faster than the carton, walks up under the rear carton flap 22 to slightly raise the flap to facilitate engagement with the folding brushes presently described. This arrangement is appropriate for long flaps.

Figure 5:
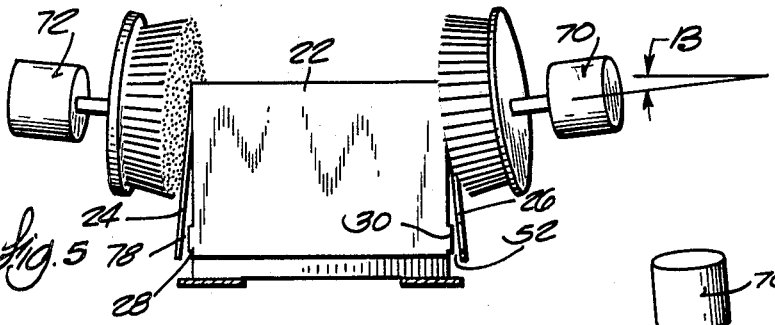
FIG. 5 is a view along line 5—5 of FIG. 4.
Figure 4:
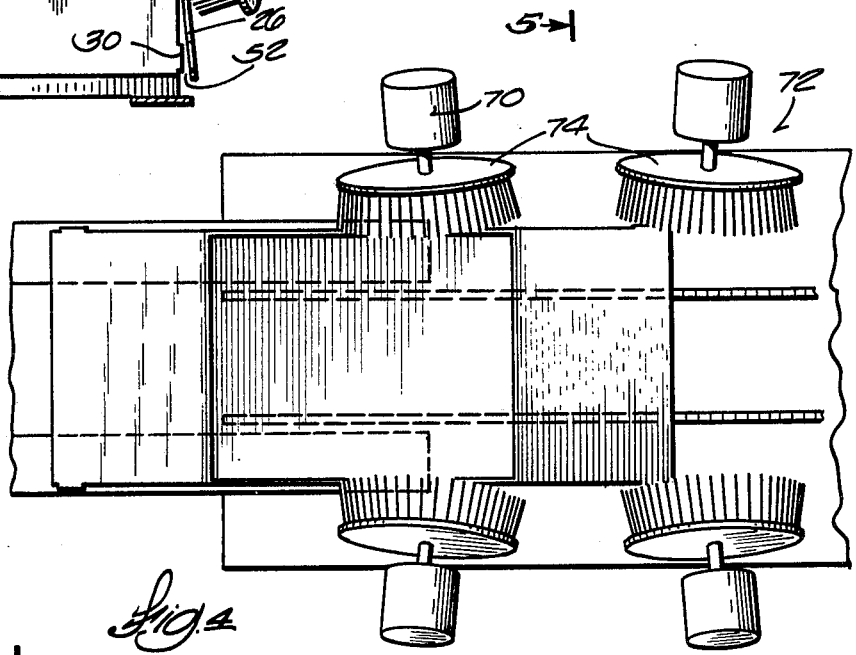
FIG. 4 is an enlarged diagrammatic plan view of pairs of flap folding brushes associated with the carton conveying path.

In accordance with the invention, flap engaging brushes or elements are provided to raise the leading flap 20 and raise and fold the trailing flap 22. In the disclosed construction, the flap engaging elements comprise brush assemblies 70 and 72 (FIGS. 4, 5, 6). FIG. 6 shows a single brush assembly 72 for raising the leading flap 20 and a single brush assembly 70 for raising and folding the trailing flap 22. FIG. 4 shows two rear flap brush assemblies 70, 72 and two leading flap brush assemblies 72. The four brush assemblies arranged as shown in FIG. 4 maintain the cartons in a centered position on the conveyor 36 during the flap folding sequence. It may be preferable to employ one of the opposite pairs of rear brushes 70 to engage and lift the trailing flap 22 upward to the position shown in FIG. 6, and the other brush 70 of the rear pair can be used to complete the arc of folding movement from the FIG. 6 position to a position folded over the top of the carton.

Figure 10:
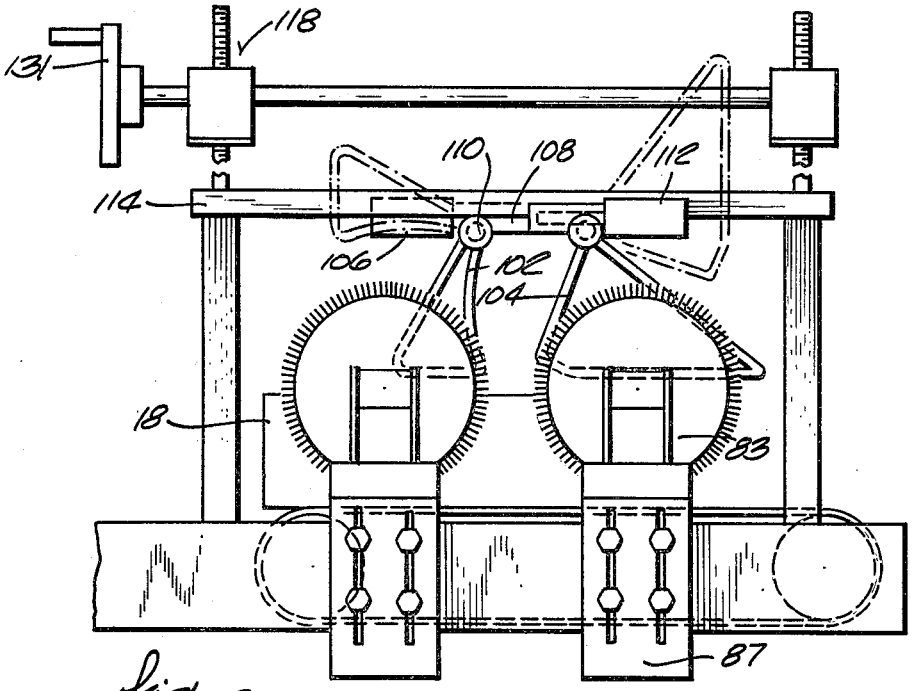
FIG. 10 is a diagrammatic fragmentary side elevation view of folding brushes and the flap hold down mechanism
Figure 11:
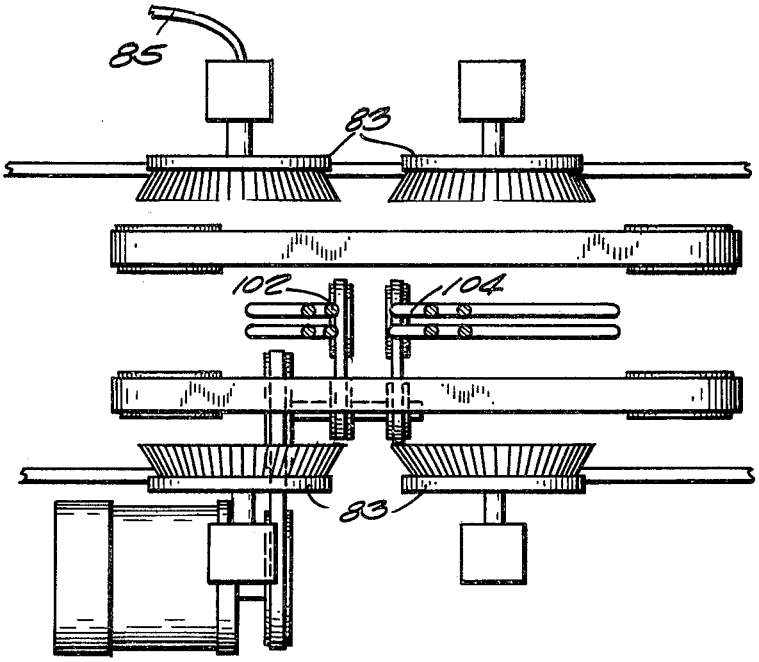
FIG. 11 is a plan view of the apparatus shown in FIG. 10.

Each brush assembly includes a brush mounting head 74 (FIG. 6) which contains a clump of bristles 76 which extend outwardly from the head 74. Each brush assembly includes a motor 80 for rotating the brush head. Means are also provided for supporting the brushes for universal movement to enable adjustment of the brush heads to the appropriate position for the carton size being processed and for the desired folding action. In the construction disclosed in FIG. 1, the means comprises a swivel mount 82 which provides movement about two transverse axes. The motors 80 can also be mounted on slides 84 to afford movement of the brush heads longitudinally along one of the axes. The mounts 82 enable the brushes to be locked in the selected position. Alternatively, they can be oscillated into the conveyor path in appropriate timed sequence. Other brush drive and mounting arrangements can be employed. In FIGS. 10 and 11, the brush heads 83 are driven by flexible cables 85. The brush heads in FIGS. 10 and 11 can be supported on vertically, laterally and angularly adjustable brackets 87 to enable proper positioning of the brushes relative to the cartons. Good folding action results if the centers of the brush heads are about the same height as the corners 77 (FIG. 6) of the cartons.

Figure 1:
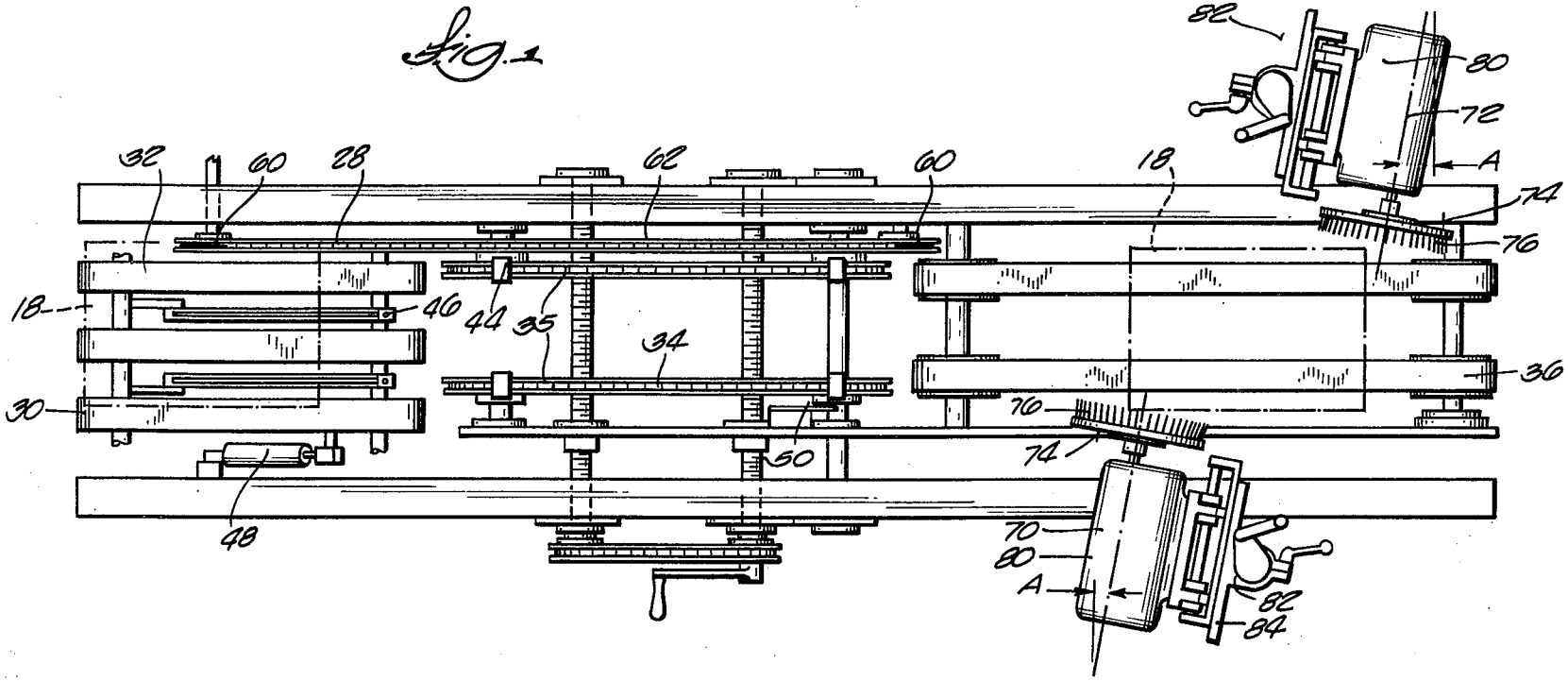
FIG. 1 is a diagrammatic plan view of the carton flap folding apparatus of the invention.
Figure 2:
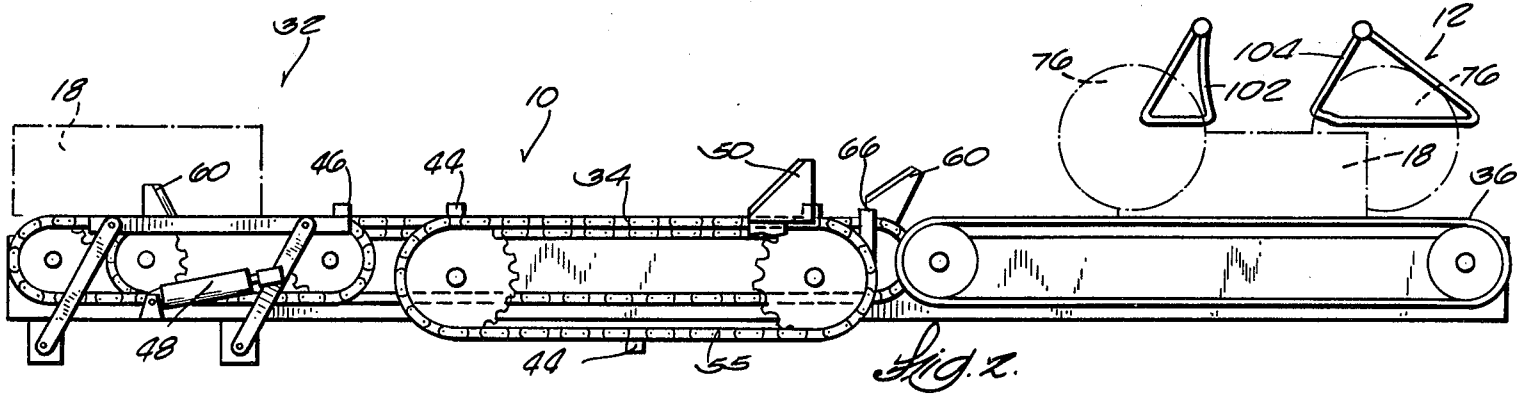
FIG. 2 is a diagrammatic side view of the carton flap folding apparatus shown in FIG. 1.

As shown in FIG. 1, the brushes may be inclined at an angle A with respect to a line normal or perpendicular to the carton sides and conveying path. Inasmuch as the bristles 76 which sweep the rear flaps 22 upwardly, forwardly and downwardly are traveling in arcs 85 and 86 illustrated in FIG. 6 to accomplish this movement, the bristles need not engage the carton during arc portion 85 and thus the brush head can be inclined at angle A to provide clearance during arc portion 85. One brush 70 can be employed to cause flap movement during arc 85 and another positioned to provide engagement and flap movement through arc 86. Similarly, with the brush assembly 72 the bristles 76 only have to be engaged with the leading flaps 20 and the carton during the arc portion 88 illustrated in FIG. 6 to swing the forward flaps 20 upwardly so that it can be engaged by a swing arm as subsequently described.

In addition to inclination of the brushes with respect to a line normal to the carton sides, the brushes also may be inclined at an angle B (FIG. 5) with respect to a horizontal plane. The angle B insures good gripping of the brush elements with the flaps during the sweeping action. Although bristle brushes are illustrated, compressible or deformable pads with a friction surface can be employed.

Means are provided for completing the closing of the leading and trailing end flaps after the folding action of the brushes. In the disclosed construction, as best illustrated in FIGS. 10 and 11, the means includes swing arms 102 and 104. Means are provided for moving the swing arms from advanced positions to engage the leading and trailing end flaps and retracted clearance positions above the cartons. As disclosed, the means comprises an air cylinder 106 which is connected to a gear rack 108. The rack 108 is in mesh with a gear on the shaft 110 which is fixed to arm 108. Actuation of the cylinder 106 causes counter-clockwise movement (FIG. 10) of arm 102 downwardly and forwardly from the position shown in broken lines to the position shown in full lines to engage a partially folded rear flap and complete the fold. Similarly, the swing arm 104 is moved by an air cylinder 112 and rack and gear assembly. The arm 104 is moved in a clockwise direction (FIG. 10) downwardly and rearwardly. The swing arms 102, 104 and the mechanism for swinging the arms are mounted on a frame 114 which is vertically adjustable with a hand crank 131 and elevating mechanism 118 to accommodate different size cartons. Alternatively, a fixed plow 120 (FIG. 9) located above the carton conveying path can be employed to complete the closure of the leading flap 20 and hold down both the leading and trailing flaps 20 and 22 while glue is being applied to the tops of flaps 20 and 22 by a glue applicator 100 at the glue station 14. The plow 120 desirably holds the flaps 20 and 22 down over the top of the carton until the spaced folding plows 130 located on opposite sides of the carton conveying path fold the side flaps 24 and 26 up and over the end flaps and the pressure belt 101 causes bonding of the glue on the flaps.

What is claimed is:

1. Apparatus for folding carton flaps comprising conveying means for conveying cartons with leading and trailing downturned flaps along a conveying path through a flap folding station, folding means including flap engaging elements, means for supporting and rotating said elements relative to said path and said cartons to engage said carton flaps, said means for rotating said elements providing rotation of said elements about an axis transverse to the direction of conveyor movement, which axis intersects the conveying path and the cartons carried on said conveying path so that said flap engaging elements engage the carton flaps during a portion of the upward arc of travel of the engaging elements to sweep the flaps upwardly and over the carton top.

2. Apparatus in accordance with claim 1 wherein said flap engaging elements are flexible and yieldable.

3. Apparatus in accordance with claim 2 wherein said flap engaging elements comprise brush heads with a plurality of bristles extending toward the path of carton movement on the conveying means and wherein the axes of rotation of said brushes are at an angle with respect to the path of carton movement to afford clearance of the bristles with the carton side walls when the bristles are not traversing the arc required to cause folding movement of the flaps.

4. Apparatus in accordance with claim 1 wherein said cartons have four downturned closure flaps with the front and rear flaps interconnected at diagonal corners to side flaps and including knife means associated with said conveying means for severing the connecting webs connecting the flaps in advance of said flap folding station.

5. Apparatus for folding carton flaps comprising a frame, conveying means associated with said frame for conveying cartons with downturned leading and trailing flaps along a conveying path through a flap folding station, first and second brush pairs at the flap folding station, each of said brushes having brush heads with brush elements, means for rotating said brushes, means for supporting said first brush pair on said frame with a brush in each pair on opposite sides of the conveying path and positioned relative to said conveying path and to cartons carried on said conveyor so that said brush elements of said first brush pair sweep through planes which intersect and converge into the conveying path for contact of the brush elements with the leading carton flap during upward and rearward movement of the brush elements to sweep the leading flap upwardly above the carton top, and means for supporting said second brush heads on said frame at opposite sides of the conveying path and positioned relative to said conveying path and to cartons carried on said conveyor so that brush elements of said second brush pair sweep through planes which intersect and converge into the converging path for contact of the brush elements with the trailing flap edge during upward and forward movement of said brush elements to cause upward and forward folding of said trailing flap about the top of the carton.

6. Apparatus in accordance with claim 5 including a plow located down stream of said brush pairs along said conveying path to fold said leading flap downwardly.

7. Apparatus in accordance with claim 5 wherein said means for mounting said brushes affords adjustment of the position of said brush elements relative to the conveying path to accommodate cartons of different sizes.

8. Apparatus in accordance with claim 5 including swing arms located above the carton conveying path and means to swing said arms to engage the carton leading and trailing flaps and fold the flaps downwardly over the top of the carton.

9. In apparatus for folding carton flaps above the top of the carton, including a conveyor for conveying the cartons to a flap folding station, the improvement comprising two pairs of counter rotating sweeping heads positioned relative to said carton for rotation about a transverse and conveyor path intersecting axes to engage the leading and trailing flaps on said carton and swing the flaps upwardly from a downturned position as the carton is conveyed past said sweeping heads and wherein the sweeping heads of each pair have flap engaging elements in convergent planes relative to the carton conveying path.

10. The improvement of claim 9 wherein the sweeping heads in a pair are positioned relative to the carton conveying path so that one sweeping head in a pair engages a flap to provide a first arc portion of folding movement and the second sweeping head in the pair engages the carton flap to finish the arc of folding movement.

11. The improvement of claim 9 wherein said sweeping heads have flexible and deformable elements positioned to rotate in planes which intersect the carton conveying path and said conveying means squeezes the cartons through said deformable elements.

12. The improvement of claim 9 including knife means upstream of the flap folding station and in line with said conveying path to slit connecting webs for said flaps, and plows downstream of said folding station to fold carton side flaps over the folded carton end flaps.

13. The improvement of claim 9 wherein said sweeping heads comprise bristles arranged in an annular ring with the centers of the rings positioned at the height of the carton corners at the hinge line about which the leading and trailing flaps are folded.

14. Apparatus for folding carton flaps having downturned leading and trailing flaps comprising conveying means for conveying cartons along a conveying path through a flap folding station, folding means at said flap folding station including flap engaging elements, means for supporting and rotating said elements relative to said conveying path and said cartons to engage said carton flaps, said means for rotating said elements providing rotation of said elements about an axis transverse to the direction of conveyor movement, which axis intersects the conveying path and wherein said means for supporting said elements positions said elements so that said elements project into said conveying path to engage the sides of the carton as the carton moves through said flap folding station and so that said flap engaging elements engage the carton flaps during a portion of the upward arc of travel of the engaging elements to sweep the flaps upwardly to an upturned position.

* * * * *